US005195257A

United States Patent [19]

Holcomb et al.

[11] Patent Number: 5,195,257

[45] Date of Patent: Mar. 23, 1993

[54] ATHLETIC SHOE SOLE

[76] Inventors: Robert R. Holcomb, R.R. 1, Box 104, Hackleberg, Ala. 35564; Donald W. Bowlin, 206 Pine St., Florence, Ala. 35630

[21] Appl. No.: 650,913

[22] Filed: Feb. 5, 1991

[51] Int. Cl.[5] ..... A43B 13/18

[52] U.S. Cl. ..... 36/28; 36/3 B; 36/71

[58] Field of Search ..... 36/28, 29, 71, 3 B, 36/35

[56] References Cited

U.S. PATENT DOCUMENTS

| | | | |
|---|---|---|---|
| 3,027,659 | 4/1962 | Gianola | 36/3 R |
| 4,129,951 | 12/1978 | Petrosky | 36/29 |
| 4,229,889 | 10/1980 | Petrosky | 36/28 |
| 4,258,480 | 3/1981 | Famolare, Jr. | 36/91 |
| 4,336,661 | 6/1982 | Medrano | 36/44 |
| 4,342,158 | 8/1982 | McMahon et al. | 36/35 R |
| 4,358,902 | 11/1982 | Cole et al. | 36/28 |
| 4,414,760 | 11/1983 | Faiella | 36/29 |
| 4,446,634 | 5/1984 | Johnson et al. | 36/28 X |
| 4,458,430 | 7/1984 | Peterson | 36/28 |
| 4,486,964 | 12/1984 | Rudy | 36/28 |
| 4,546,555 | 10/1985 | Spademan | 36/28 |
| 4,567,677 | 2/1986 | Zona | 36/43 |
| 4,590,689 | 5/1986 | Rosenberg | 36/3 B |
| 4,593,482 | 6/1986 | Mayer | 36/28 X |
| 4,779,359 | 10/1988 | Famolare, Jr. | 36/29 |
| 4,852,274 | 8/1989 | Wilson | 36/29 |
| 4,860,463 | 8/1989 | Pin | 36/3 B |
| 4,887,367 | 12/1989 | Mackness et al. | 36/28 |
| 4,934,072 | 6/1990 | Frederickson et al. | 36/28 X |

FOREIGN PATENT DOCUMENTS

| | | | |
|---|---|---|---|
| 2225212 | 5/1990 | United Kingdom | 36/28 |

*Primary Examiner*—Paul T. Sewell
*Assistant Examiner*—Beth Anne Cicconi
*Attorney, Agent, or Firm*—Mallinckrodt & Mallinckrodt

[57] ABSTRACT

An athletic shoe having a sole construction comprising a heel plenum configured to accommodate the tuberosity of the calcaneous of the heel of the user, a forefoot plenum preferably having a plurality of interconnecting plenum members configured to accommodate a corresponding plurality of metatarsal heads of the forefoot of the user, both plenums being preferably filled with cushioning material and compressed air and being interconnected by passageways for the controlled flow of air back and forth between the plenums during wearing of the shoe.

29 Claims, 2 Drawing Sheets

ATHLETIC SHOE SOLE

BACKGROUND OF THE INVENTION

1. Field

The invention is in the field of athletic shoes having soles provided with air cushions.

2. State of the Art

It has been generally recognized for many years that certain athletic events, in particular those involving a good deal of running or walking, can result in tiring and even long term damage to the feet of participants. As a result, shoes with various types of soles have been devised to reduce the impact on the foot when the shoe strikes the ground or other playing surface. Usually these have included the insertion in the sole of some form of resilient compressive material which reduces the peak pressure experienced by the foot as the energy of the impact is absorbed. In some shoes, air has been employed to augment the cushioning, usually involving means whereby the air can be successively and alternately exchanged between inner portions of the sole and the external atmosphere.

However, existing shoes of this type do not effectively optimize cushioning of the impact on the most affected parts of the foot, namely the tuberosity of the calcaneous in the heel region and the heads of the metatarsal bones in the forefoot region.

SUMMARY OF THE INVENTION

A principal object in the making of the present invention was to devise a sole for an athletic shoe that would reduce and otherwise optimize the impact pressure transmitted to the most vulnerable parts of an athlete's foot as his shoe contacts the ground or other running or playing surface. These most vulnerable parts have been found to be the tuberosity of the calcaneous in the heel region, and the heads of the metatarsal bones in the forefoot region.

Effective reduction in pressure on the foot is obtained in accordance with this invention by providing a compressible fluid, e.g., air, in a plenum encapsulated in the heel region and in another plenum encapsulated in the forefoot region, both plenums being in effect bladders. An interconnecting passageway is provided between these two plenums such that the air is successively and alternately pumped back and forth between the two as the athlete's weight is transferred from his heel to his forefoot, and vice versa.

Optimization of the plenum pressure versus time is effected by a proper choice of the relative volumes of the plenums, the size of the interconnecting passageway or passageways, and the porosity of any materal filling the bladder. Additionally, further optimization is obtained by providing a difference in the size of the air flow passage from heel to forefoot and forefoot to heel. This may be easily accomplished by providing two passageways extending between the heel and forefoot plenums, one passageway having a one way valve incorporated therein so that flow from the heel to the forefoot plenum is through a single passageway and flow back from the forefoot to heel plenum is through both passageways.

Still further optimization is achieved by shaping the heel plenum in the form of a toroid and either placing a cushioning pad in the central hole of the toroid, or covering the toroid bladder with a resilient pad having a central protrusion which engages the central hole of the toroid, substantially filling it. This serves to spread the load over the plenum region and to minimize the pressure on the tuberosity of the calcaneous and, at the same time, to prevent the tuberosity from being depressed into the central portion of the plenum farther than desirable, which could result in the undesirable feeling of a "hole" under the heel. In like manner, the forefoot plenum is shaped in the form of interconnected toroids, each of which is centered approximately under a metatarsal head and each of which is covered by a resilient pad having a central protrusion.

THE DRAWINGS

The best mode presently contemplated for carrying out the invention is shown in the accompanying drawings in which:

FIG. 1 is a bottom plan view showing schematically the heel plenum, the forefoot plenum, and two side-by-side passageways interconnecting the two plenums, bony portions of a foot being shown in phantom as it would overlie a shoe sole in which the plenums and interconnecting passageways are incorporated;

FIG. 2, an exploded view showing the shoe sole in longitudinal vertical section and the interconnected plenums and the bony structure of a foot thereabove in perspective;

FIG. 3, a transverse section taken through the heel plenum on the line 3—3 of FIG. 1; and FIG. 4, a perspective view of a configuration of resilient material which can be used inside the plenums of the invention, such as the heel plenum shown in FIG. 2, and drawn to a larger scale.

DETAILED DESCRIPTION OF THE ILLUSTRATED EMBODIMENT

Figure 1:
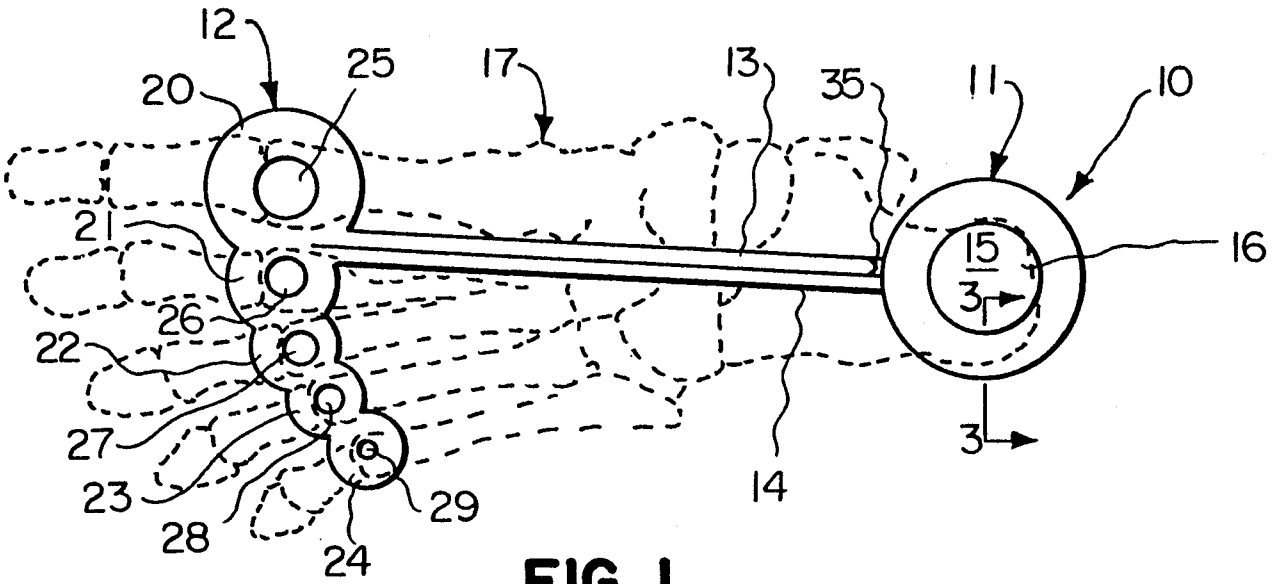
Figure 2:
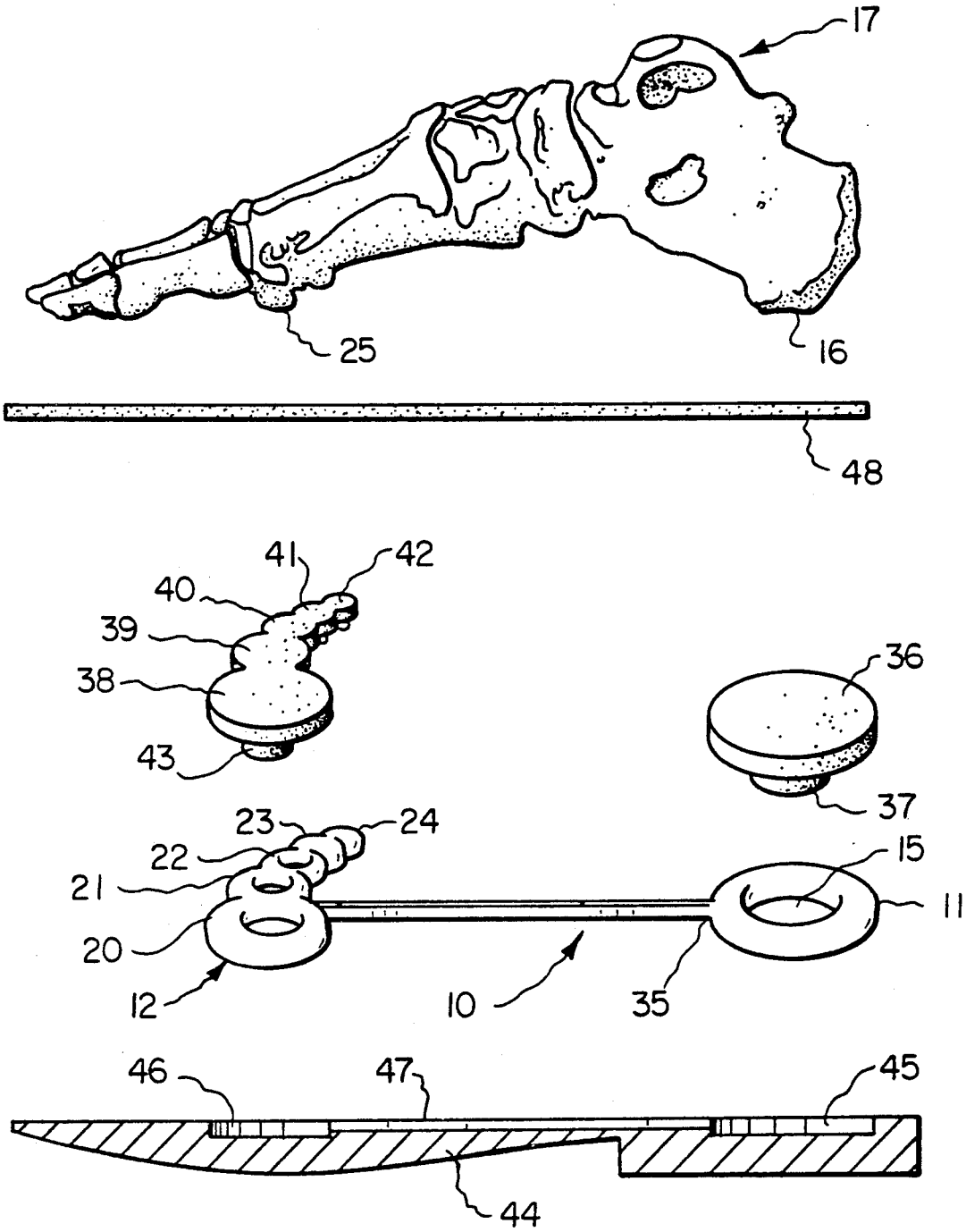

As illustrated, a closed pneumatic system 10 has a heel plenum 11 and a forefoot plenum 12, fashioned as bladders and interconnected by two plastic tubular passageways 13 and 14 arranged side by side as shown in FIGS. 1 and 2. The plenums and passageways are closed, i.e. they form a closed system which is sealed against intake or outflow of fluid. During manufacture, they are filled with a compressible fluid, usually air, which may be pressurized above ambient. Indeed, it is anticipated that two or three different models will be employed having different air pressures so as to accomodate users of different weights. The filling with pressurized air is normally accomplished by way of a conventional valve (not shown) or any other way in which a pressurized fluid can be introduced into the plenums and captured thereby.

Figure 3:
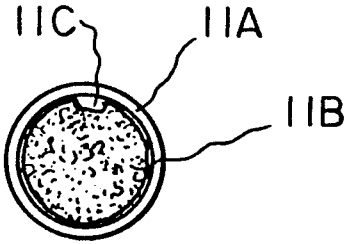

The heel plenum 11 takes the form of a bladder formed of a flexible material **11*a*, FIG. 3, such as vulcanized rubber of appropriate weight to allow a desired small amount of expansion under pressure, and is preferably toroidal in shape, here shown as of circular doughnut shape, with a central hole 15 passing therethrough. Such heel plenum 11 is shaped and sized to support the area of the heel immediately surrounding the tuberosity 16 of the calcaneous bony structure 17** of the user's foot, thus providing a cushion for it.

Figure 4:
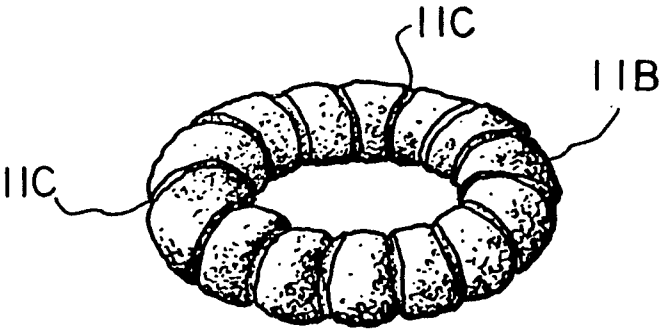

In order to prevent collapse of the plenum 11 to an extent greater then desired if greater than expected pressure is applied thereto, or to prevent complete collapse if a plenum should rupture, a flexible resilient material **11*b*, such as a sponge rubber or a similar elastomer material, is provided within plenum 11, FIG. 3. The flexible resilient material 11***b*, FIG. 4, is shaped similarly to the plenum 11 and preferably includes a spiral passage or groove 11*c* extending about its outer surface to provide an initially unimpeded passage for the flow of air from all parts of plenum 11 to passageway 13. It is preferred that the foam material be such as to prevent collapse of the bladder beyond about one third of its volume.

The forefoot plenum 12 is likewise fashioned from a similar flexible material forming a series of interconnected bladders in the shape of a series of interconnected toroids, 20, 21, 22, 23, 24, here shown as each being also of circular, doughnut shape. In the embodiment shown, five such toroids are employed, the more important of these being plenums 20, 21, and 22. As an option, toroids 23 and 24 may be omitted. In any event, the toroids of this forefoot plenum 12 are positioned so as to lie approximately beneath the metatarsal heads 25, 26, 27, 28, and 29, respectively, of the bony structure 17 of the user's foot and each is sized so as to support and cushion the area immediately surrounding its corresponding metatarsal head. As with the heel plenum, each toroid of the forefoot plenum 19 is filled with a flexible resilient material to prevent total collapse of the plenum.

Passageways 13 and 14 are fabricated from flexible, but essentially non-resilient, tubular material, such as plastic which is pliable but substantially non-expansible and non-compressible under the load to be encountered. Normally, both tubes will be of the same size, although not necessarily so. In the present embodiment, tube 14 incorporates a one-way valve 35, such as a conventional check valve, which permits air to flow from the forefoot plenum to the heel plenum, but not in the reverse direction. Thus, fluid can flow from heel plenum to forefoot plenum only through passageway 13 but fluid can flow from forefoot plenum to heel plenum through both passageways 13 and 14. If passageways 13 and 14 are of the same size, it requires about four times the pressure on the heel plenum as on the forefoot plenum to cause similar fluid flow between the plenums.

As pressure is exerted on the heel plenum during impact by the heel of the wearer of the shoe, the heel plenum partially collapses and air is forced from the heel plenum to the forefoot plenum through passageway 13. As the weight of the wearer shifts to the forefoot, the forefoot plenum partially collapses and air is forced from the forefoot plenum back to the heel plenum through both passageways 13 and 14, thus reinflating the heel plenum. Since the heel plenum experiences most of the impact of the wearer's foot and the forefoot plenum experiences less, the passageway for air to flow from the forefoot plenum to the heel plenum is optimally made larger, which accounts for the one-way valve in tube 14. In any event, the tubes and plenums are so sized and the flexible material so selected that the air can be pumped back and forth between the two plenums during the appropriate time periods resulting from a wearer's foot first impacting and then lifting from the plenums during the course of running, walking, or other activity. It is to be noted that if the air does not move out of the heel plenum rapidly enough, the impact shock from the runner's heel would not be minimized optimally, and, conversely, if the air moves out too rapidly, the heel plenum will collapse too quickly, thus partially defeating its purpose. Similar statements can be made concerning the forefoot plenum. During running, the heel of a runner strikes the running surface with a force of up to about five times the runner's weight, while the force applied to the forefoot as the runner's weight is shifted to the forefoot and the runner pushes off to the other foot is about one and one half times the runners weight. This is about a four to one ratio. Thus, the passageways connecting the heel and forefoot plenums should allow desired deflation of the forefoot plenum under about one fourth the force required to cause a similar deflation of the heel plenum. With an average of six heel strikes per second during average running, it is believed that a satisfactory selection of the variables is one wherein the volume of the heel plenum is reduced by approximately one-third in two hundred milliseconds following the start of heel impact, followed by similar volume reduction of the forefoot plenum as the weight shifts to the forefoot. These variables and preferred rates are merely those presently thought to be best, and it may be found through additional testing that other variables and rates may provide better results. Further such variables and rates may vary for different activities.

As shown in FIG. 2, when the plenum is in the form of a toroid with a central hole, it is preferable that a pad 36 of a cushioning material, such as a resilient foam similar to that used in the plenums, be positioned above the heel plenum 11, with a central protrusion 37 extending therefrom sized and shaped to substantially fill the toroidal central hole 15 of such heel plenum. This material is to provide cushioning for the heel, particularly the portion thereof above the hole, so as to avoid the feeling of a hole in the plenum.

In a similar manner, pads 38–42 are preferably positioned relative to forefoot plenum 12 so that the central protrusion, see the protrusion 43, FIG. 2, will substantially fill its corresponding toroidal central hole.

The shoe sole 44 has a cavity 45 fashioned in it and sized and shaped so as to accomodate heel plenum 11 and its pad 36, 37. Likewise sole 44 has a cavity 46 fashioned in it and sized and shaped so as to accomodate the several toroids of forefoot plenum 12 and their pads 38–42 with corresponding protrusions. Additionally, a longitutidinal cavity 47 is fashioned in shoe sole 43 and is sized so as to accomodate tubular passageways 13 and 14. The plenums, pads, and tubular passageways are preferably secured in place by means of a conventional inner sole 48.

While the plenums have been described and shown as toroidal in shape, various shapes could be provided, with or without the central hole. Further, while two similarly sized connecting tubes between the heel and forefoot plenums have been shown, such tubes could be of different sizes or provide flow passages of different sizes, or additional passages, with or without valves or other flow restrictions, could be used.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. In an athletic shoe, a sole construction having a fluid filled closed system, comprising a hallow, toroidal-shaped, semi-collapsible heel plenum having a central hole therethrough, said heel plenum sized and horizontally positioned to lie beneath and substantially support the tuberosity of the calcaneous of a heel of a wearer's foot; cushioning material at least partially filling the heel plenum; a hallow, semi-collapsible forefoot plenum sized and positioned to lie beneath and substantially support the metatarsal heads of the bony structure of a forefoot of a wearer's foot; fluid within said plenums; a plurality of flow passages interconnecting the two plenums and sized to nonadjustably allow a predetermined flow of fluid therethrough; a one way valve in at least one of the plurality of flow passages to allow flow of fluid through said at least one flow passage in only one direction, whereby the fluid flows in one direction between the plenums at a greater rate than in the other direction.

2. In an athletic shoe, a sole construction according to claim 1, wherein at least one flow passage has a one way valve therein and at least one flow passage allows flow of fluid therethrough in either direction whereby fluid flows in one direction between the plenums through a greater number of flow passages than when flowing in the opposite direction between the plenums.

3. In an athletic shoe, a sole construction according to claim 2, wherein there are two flow passages, and a one way valve is provided in one of the passages.

4. In an athletic shoe, a sole construction according to claim 3, wherein the flow passages each have the same cross-sectional area and the one way valve allows flow from the forfoot plenum to the heel plenum to thereby require about four times the pressure on the heel plenum as on the forefoot plenum to cause similar flow of fluid from the heel plenum to the forefoot plenum as from the forefoot plenum to the heel plenum.

5. In an athletic shoe, a sole construction according to claim 1, wherein the cushioning material has a spiral groove extending therearound.

6. In an athletic shoe, a sole construction according to claim 1, wherein a flexible resilient pad is positioned above the heel plenum.

7. In an athletic shoe, a sole construction according to claim 6, wherein the pad has a central protruding portion which at least partially fills the central hole of the heel plenum.

8. In an athletic shoe, a sole construction according to claim 1, wherein the fluid is compressed to a pressure greater than ambient.

9. In an athletic shoe, a sole construction according to claim 1, wherein the fluid is air.

10. In an athletic shoe, a sole construction according to claim 1, wherein the heel plenum, the component members of the forefoot plenum, the passageways, and the fluid pressure are selected so as to allow reduction of the volume of the heel plenum by approximately one-third in substantially two hundred milliseconds following onset of impact by the foot of the user.

11. In an athletic shoe, a sole construction according to claim 1, wherein the flow of fluid at the greater rate is from the forefoot plenum to the heel plenum.

12. In an athletic shoe, a sole construction according to claim 1, wherein the flow passages include flexible hollow tubes interconnecting the plenums.

13. In an athletic shoe, a sole construction having a fluid filled closed system, comprising a hollow, semi-collapsible heel plenum sized and positioned to lie beneath and substantially support the tuberosity of the calcaneus of a heel of a wearer's foot; a hollow, semi-collapsible forefoot plenum sized and positioned to lie beneath and substantially support the metatarsal heads of the bony structure of a forefoot of a wearer's foot, said forefoot plenum being formed of a plurality of hollow, interconnected, toroidal-shaped members, each having a central hole therethrough and horizontally positioned beneath the forefoot of a wearer's foot; fluid within said plenums; a plurality of flow passages interconnecting the two plenums and each sized to nonadjustably allow a predetermined flow of fluid therethrough; a one way valve in at least one of the plurality of flow passages to allow flow of fluid through said at least one flow passage in only one direction, whereby the fluid flows in one direction between the plenums at a greater rate than in the other direction.

14. In an athletic shoe, a sole construction according to claim 13, wherein each of the toroidal-shaped members is at least partially filled with a cushioning material.

15. In an athletic shoe, a sole construction according to claim 14, wherein the cushioning material in each toroidal-shaped member has a spiral groove extending therearound.

16. In an athletic shoe, a sole construction according to claim 13, wherein flexible resilient pads are positioned above the forefoot plenum.

17. In an athletic shoe, a sole construction according to claim 16, wherein the pads have protruding portions which at least partially fill the central holes of the forefoot plenums.

18. In an athletic shoe, a sole construction according to claim 13, wherein at least one flow passage has a one way valve therein and at least one flow passage allows flow of fluid therethrough in either direction whereby fluid flows in one direction between the plenums through a greater number of flow passages than when flowing in the opposite direction between the plenums.

19. In an athletic shoe, a sole construction according to claim 18, wherein there are two flow passages, and a one way valve is provided in one of the passages.

20. In an athletic shoe, a sole construction according to claim 13, wherein the flow of fluid at the greater rate is from the forefoot plenum to the heel plenum.

21. In an athletic shoe, a sole construction having a fluid filled closed system, comprising a hollow, toroidal-shaped semi-collapsible heel plenum sized and positioned to lie horizontally beneath and to substantially support the tuberosity of the calcaneus of a wearer's foot; a hollow, semi-collapsible forefoot plenum, made up of a plurality of interconnected, toroidal-shaped members, being sized and positioned to lie horizontally beneath and to substantially support the metatarsal heads of the bony structure of the wearer'foot; fluid within said plenums; and fluid flow means extending between and interconnecting said plenums to allow fluid flow between said plenums in response to differential pressures applied to said plenums.

22. In an athletic shoe, a sole construction according to claim 21, wherein the heel plenum is at least partially filled with a cushioning material.

23. In an athletic shoe, a sole construction according to claim 22, wherein a flexible resilient pad is positioned above the heel plenum.

24. In an athletic shoe, a sole construction according to claim 23, wherein the pad has a central protruding portion which at least partially fills the central hole of the heel plenum.

25. In an athletic shoe, a sole construction according to claim 22, wherein the cushioning material has a spiral groove extending therearound.

26. In an athletic shoe, a sole construction according to claim 22, wherein each of the toroidal-shaped members of the forefoot plenum is at least partially filled with a cushioning material.

27. In an athletic shoe, a sole construction according to claim 26, wherein the cushioning material in each toroidal-shaped member has a spiral groove extending therearound.

28. In an athletic shoe, a sole construction according to claim 22, wherein flexible resilient pads are positioned above the forefoot plenum.

29. In an athletic shoe, a sole construction according to claim 28, wherein the pads have protruding portions which at least partially fill the central holes of the forefoot plenums.

* * * * *